US006257134B1

(12) United States Patent
Zuber et al.

(10) Patent No.: US 6,257,134 B1
(45) Date of Patent: Jul. 10, 2001

(54) DEVICE FOR SAFEGUARDING OR PROTECTING AGAINST PENETRATION BY FOREIGN BODIES INTO A ROLLER NIP

(75) Inventors: Mathias Zuber, Helmstadt-Bargen; Ludwig Becker, Reilingen, both of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/360,485

(22) Filed: Jul. 23, 1999

Related U.S. Application Data

(62) Division of application No. 09/084,556, filed on May 26, 1998, now Pat. No. 6,009,801.

(30) Foreign Application Priority Data

May 26, 1997 (DE) ..... 197 21 912

(51) Int. Cl.[7] ..... B30B 15/28; B30B 3/04; B41F 33/00

(52) U.S. Cl. ..... 100/342; 100/170; 100/171; 101/216; 101/483

(58) Field of Search ..... 100/342, 168, 100/169, 171; 101/216, 247, 477

(56) References Cited

U.S. PATENT DOCUMENTS

| | | | | |
|---|---|---|---|---|
| 480,522 | * | 8/1892 | Skekel | 100/168 |
| 571,266 | | 11/1896 | Favrow . | |
| 1,184,294 | * | 5/1916 | Aitken | 100/168 |
| 2,862,360 | | 12/1958 | Audemar . | |
| 3,448,684 | * | 6/1969 | Cardinet et al. | 100/171 |
| 3,498,217 | | 3/1970 | Kletti . | |
| 3,541,592 | * | 11/1970 | Lewis | 100/168 |
| 4,454,812 | | 6/1984 | Johne et al. . | |
| 4,464,985 | | 8/1984 | Asanuma et al. . | |
| 4,495,863 | | 1/1985 | Despot et al. . | |
| 4,917,407 | | 4/1990 | Alich . | |
| 4,958,558 | * | 9/1990 | Harreither | 100/168 |
| 5,111,250 | | 5/1992 | Kashiwagi . | |
| 5,309,832 | | 5/1994 | Merkel et al. . | |
| 5,537,922 | | 7/1996 | Becker . | |
| 5,562,033 | | 10/1996 | Schild et al. . | |
| 5,662,950 | * | 9/1997 | Kusago | 100/168 |
| 5,678,485 | | 10/1997 | Guaraldi . | |

FOREIGN PATENT DOCUMENTS

| | | | |
|---|---|---|---|
| 32 11 154 A1 | | 10/1983 | (DE) . |
| 42 18 602 C2 | | 11/1993 | (DE) . |
| 44 17 054 A1 | | 11/1995 | (DE) . |
| 195 44 884 A1 | | 5/1996 | (DE) . |
| 195 00 586 A1 | | 7/1996 | (DE) . |
| 1 406 636 | | 9/1975 | (GB) . |
| 7-276610 | * | 10/1995 | (JP) . |
| 0 726 145 | * | 8/1996 | (JP) . |

OTHER PUBLICATIONS

German Patent Application No. 714 1941, dated Feb. 3, 1972.

* cited by examiner

*Primary Examiner*—Stephen F. Gerrity
(74) *Attorney, Agent, or Firm*—Herbert J. Lerner; Laurence A. Greenberg; Werner H. Stemer

(57) ABSTRACT

A method for safeguarding against the entry of foreign bodies into a nip between two cylinders, which includes applying a deflection movement to one of the cylinders counter to a spring force applied thereto so as to overcome the spring force and, in accordance with a prescribed deflection distance, alternatively keeping the spring force to be overcome constant or reducing the spring force; and a device for performing the method.

21 Claims, 4 Drawing Sheets

DEVICE FOR SAFEGUARDING OR PROTECTING AGAINST PENETRATION BY FOREIGN BODIES INTO A ROLLER NIP

This divisional application claims the benefit under 35 U.S.C. § 120 of U.S. application Ser. No. 09/084,556, filed May 26, 1998 now U.S. Pat. No. 6,009,801.

BACKGROUND OF THE INVENTION

Field of the Invention

The invention relates to a method and a device for safeguarding or protecting against penetration by foreign bodies into a roller nip, more particularly, between two cooperating cylinders, such as a contact-pressure roller cooperating with a plate cylinder in a printing press, in a manner that an automatically or semiautomatically supplied printing plate is mounted error-free on the plate cylinder and, in particular, a canted or bent trailing edge of the printing plate is introduced into a clamping and/or lock-up device for the printing plate.

A device of this general type has become known heretofore from the published German Patent Document DE 42 18 602 A1. In this known device, a contact-pressure roller corresponding in length to the length of the plate cylinder is provided, and is positionable against the plate cylinder by spring force. The spring force is applied by spiral compression springs, which have force action lines extending virtually radially to the plate cylinder. This known device has a protective function, in that a foreign member, such as a finger or hand, which may accidentally slip in between the contact-pressure roller and the plate, can displace the contact-pressure roller counter to the spring force of the spiral compression springs. A switch lever is connected to the contact-pressure roller via the shaft of the contact-pressure roller and, whenever the contact-pressure roller is deflected, actuates a switch that turns off the drive for the plate cylinder.

A disadvantage of the device disclosed in the aforementioned published German Patent Document DE 42 18 602 A1 is that the force causing the deflection of the contact-pressure roller increases as the distance traversed in the deflection increases, and can exceed an allowable distance; another disadvantage is that this force is exerted constantly on the foreign member, i.e., a finger or hand, for example.

SUMMARY OF THE INVENTION

It is therefore an object of the invention to provide a method and device for guarding against penetration by foreign bodies into a cylinder nip, wherein the force required for deflecting the contact-pressure roller is reduced to a permissible extent, and the continuous application of the force to the foreign body is also reduced or even eliminated.

With the foregoing and other objects in view, there is provided, in accordance with one aspect of the invention, a method for safeguarding against the entry of foreign bodies into a nip between two cylinders, which comprises applying a deflection movement to one of the cylinders counter to a spring force applied thereto so as to overcome the spring force; and keeping the spring force to be overcome constant in accordance with a prescribed deflection distance.

In accordance with another aspect of the invention, there is provided a method for safeguarding against the entry of foreign bodies into a nip between a plate cylinder and a contact-pressure roller disposed parallel thereto and cooperating therewith, which comprises applying a deflection movement to the contact-pressure roller counter to a spring force applied thereto so as to overcome the spring force; and keeping the spring force to be overcome constant in accordance is with a prescribed deflection distance.

In accordance with a further aspect of the invention, there is provided a method for safeguarding against the entry of foreign bodies into a nip between two cylinders, which comprises applying a deflection movement to one of the cylinders counter to a spring force applied thereto so as to overcome the spring force; and reducing the spring force in accordance with a prescribed deflection distance.

In accordance with an added aspect of the invention, there is provided a method for safeguarding against the entry of foreign bodies into a nip between a plate cylinder and a contact-pressure roller disposed parallel thereto and cooperating therewith, which comprises applying a deflection movement to the contact-pressure roller counter to a spring force applied thereto so as to overcome the spring force; and reducing the spring force in accordance with a prescribed deflection distance.

In accordance with an additional aspect of the invention, there is provided a device for safeguarding against the entry of foreign bodies into a nip between a plate cylinder and a contact-pressure roller disposed parallel thereto and cooperating therewith, comprising a movable actuating element formed with a control contour having an ascending incline and, adjoining the ascending incline, a contour segment selected from the group thereof consisting of a straight edge and a descending incline; the contact-pressure roller being formed with ends in cooperative engagement with the control contour.

In accordance with yet another feature of the invention, the device includes guides disposed at respective ends of the contact-pressure roller for displaceably supporting the contact-pressure rollers.

In accordance with yet a further feature of the invention, the device includes an adjusting element, the guides being disposed so as to be adjustable by the adjusting element.

In accordance with yet an added feature of the invention, the contact-pressure roller is formed of a contact-pressure roller body rotatably supported on a shaft.

In accordance with yet an additional feature of the invention, the actuating element is disposed so as to be deflectable counter to the force of a restoring spring and is bringable into operative engagement with a switch.

In accordance with still another feature of the invention, the actuating element is disposed so as to be displaceable in axial direction of the contact-pressure roller.

In accordance with still a further feature of the invention, the actuating element is disposed so as to be displaceable at an angle to the shaft of the contact-pressure roller.

In accordance with still an added feature of the invention, the angle is a right angle.

In accordance with still an additional feature of the invention, the guides form part of the actuating element, and the control contours are disposed in the guides so that they are in mirror symmetry with one another.

In accordance with a concomitant feature of the invention, the guides, respectively, form an acute angle with a horizontal, and the ascending incline forms with the horizontal an angle which is greater than the acute angle.

The invention offers the particular advantage that severe injuries to human operators can be prevented by the safeguarding device according to the invention. This is achieved by providing that upon the deflection of the contact-pressure roller after a high point has been exceeded, the spring force no longer increases but instead is maintained at an allowable level. In a second exemplary embodiment, this allowed spring force is reduced even further.

In the first exemplary embodiment, the maintenance of the spring force at a predetermined level is advantageously attained by a runup incline of a control contour, which merges into a straightedge support region for one end of the shaft of the contact-pressure roller; the rectilinearly extending support region is disposed perpendicularly to the line of action of the spring force.

In a second exemplary embodiment, an advantageous feature of the invention is provided in that the runup incline merges into an oppositely oriented runout decline.

In a space-saving arrangement, a tripping mechanism is disposed in the side wall of the printing press. In this regard, the control contour having the runup incline segment is formed as a piston, which is supported displaceably in a bore of the side wall. At the same time, the piston is disposed in combination with an emergency shutoff switch.

To assure that a deflection of the contact-pressure roller over the length of the plate cylinder or the contact-pressure roller or the roller or cylinder nip defined thereby will lead to the shutoff of the printing press and, in particular, of the drive mechanism of the plate cylinder, the control contour of the axially displaceable piston is disposed in mirror symmetry with the control contour fixedly disposed on the other side wall.

Other features which are considered as characteristic for the invention are set forth in the appended claims.

Although the invention is illustrated and described herein as embodied in a method and device for guarding against the penetration of foreign bodies into a roller nip, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
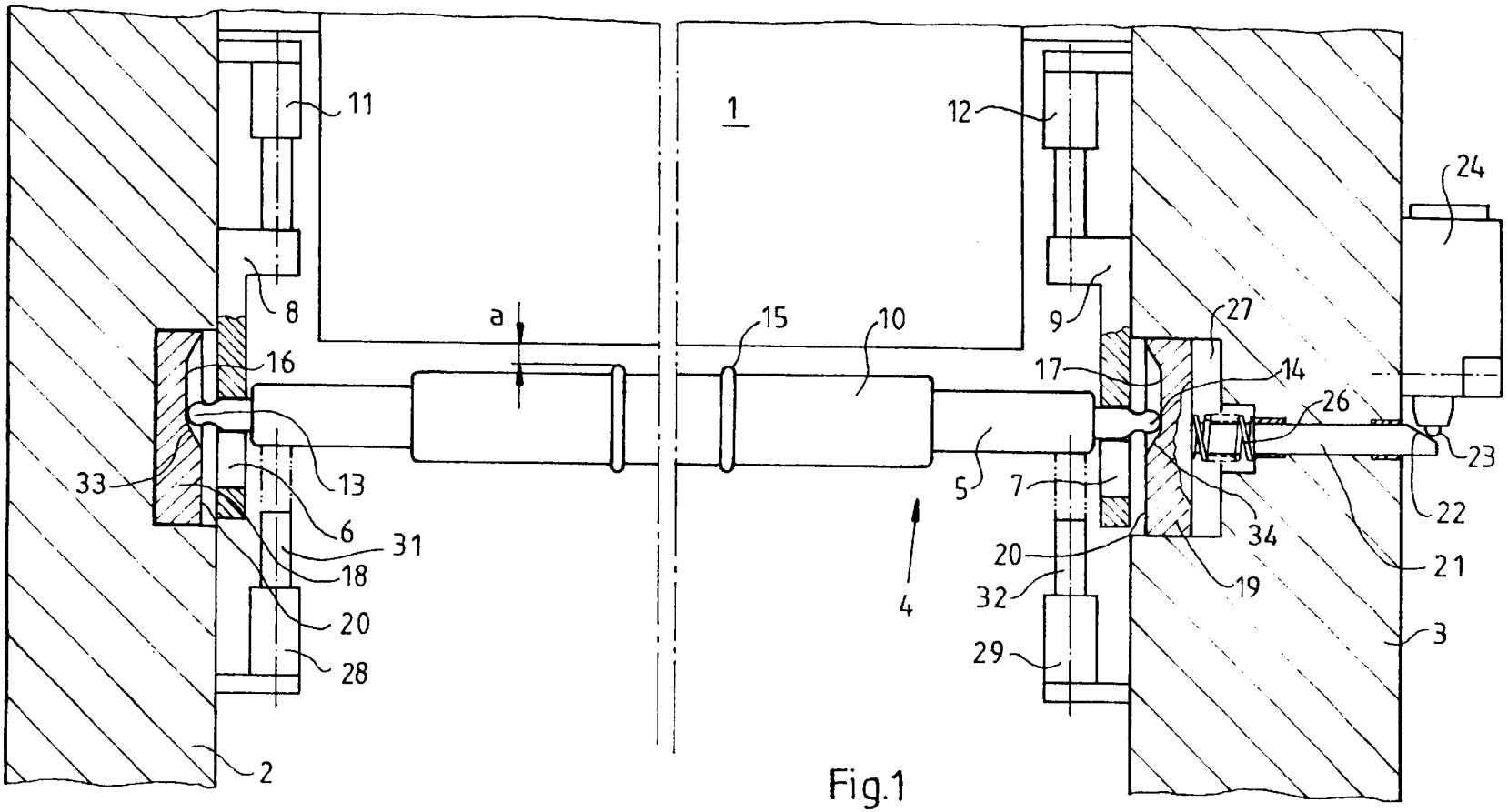
FIG. 1 is a diagrammatic top plan view, partly in section and partly broken away, of a first exemplary embodiment of the safeguarding device of the invention.

Referring now to the drawings and, first, particularly to FIG. 1 thereof, there is shown therein a plate cylinder 1 of a printing press rotatably supported in side frames 2 and 3. A contact-pressure roller 4 is disposed parallel to the axis of the plate cylinder 1. The contact-pressure roller 4 is supported by the ends thereof in a respective slot 6, 7 formed in a respective holder 8, 9. The contact-pressure roller 4 has a contact-pressure roller body carried by a roller shaft 5 and provided with rings 15, the roller body being formed as a rotatably supported sleeve 10. The holders 8 and 9 are displaceably supported on the respective side frames or walls 2 and 3. Respective pneumatic cylinders 11 and 12 execute a sliding motion having a displacement direction along an imaginary line between the axis of the plate cylinder 1 and the axis of the shaft 5 of the contact-pressure roller 4, i.e., from one to the other axis. The shaft 5 of the contact-pressure roller 4 protrudes on both sides through the respective slots 6 and 7 and, with respective spherically formed ends 13 and 14 thereof, engages a respective control contour 16, 17 of a guide 18 and an actuating element 19, respectively. The control contours 16 and 17 are formed as a mirror symmetric image of one another. The actuating element 19 is embodied as a piston having a piston rod 21 which protrudes through a bore 22 formed in the side wall 3. A control inclination or slope 22 provided at the end of the piston rod 21 is operatively engageable by a trigger or trip member 23 of a switch 24. The switch 24 is connected to the control system of the printing press and, when actuated, turns off the drive of the printing press.

A restoring spring 26 coaxially surrounds the piston rod 21 and is braced, at one end thereof, against the piston 19 and, at the other, against a bottom surface of a cylinder chamber 27 wherein the piston 19 is received, the cylinder chamber 27, in this exemplary embodiment, being formed by a bore in the side wall 3.

Adjusting cylinders 28 and 29, respectively, are disposed on the inner sides of the respective side walls 2 and 3, each of the adjusting cylinders 28 an 29 having a respective piston rod 31, 32, which is constructed so as to be extensible in order to position the contact-pressure roller 4 against the plate cylinder 1. The direction of operation is likewise an extension of the imaginary line from one of the respective axes of the plate cylinder and the contact-pressure roller to the other.

To mount a printing plate on the plate cylinder 1, the piston rods 31 and 32 are extended and engage the shaft 5 of the contact-pressure roller 4. The shaft 5 is thereby displaced to such an extent counter to the force of the pneumatic cylinders 11 and 12 in a direction towards the plate cylinder 1, that the rings 15 rest on the printing plate mounted on the plate cylinder 1.

The safeguarding or protective device according to the invention, in this position of the contact-pressure roller 4, namely when it is operatively engaged with the plate cylinder 1 or with the printing plate mounted on the plate cylinder 1, is set or placed out of operation.

The safeguarding or protective device is not activated until the piston rods 31 and 32 are retracted to the starting position thereof. The contact-pressure roller 4 is thereby displaced into a standby position by the holders 8 and 9 and, in this position, it is spaced a slight distance a =5 mm, for example, from the surface of the plate cylinder 1. In this position, the spherically formed ends of the contact-pressure roller shaft 5 rest on a runup or approach incline 33, 34 of the respective control contours 16 and 17. In this position, a deflection of the contact-pressure roller 4 caused, for example, by the entry of foreign bodies, such as fingers or hands, into the nip formed between the contact-pressure roller 4 and the plate cylinder 1, lead to a sliding of the spherical end 13, 14 in the region of the runup inclines 33 and 34, respectively, and a resultant axial movement of the contact-pressure roller 4 together with the actuating element 19 and the piston rod 21 which actuates an emergency shutoff switch.

The axial movement takes place in the region of the runup incline 33, 34 counter to the force of the restoring spring 26. After this relatively short switching distance has been bridged or spanned, the respective spherical end 13, 14 reaches a rectilinearly extending region 20 of the respective control contour 16, 17. The effect of this provision is that the contact-pressure roller 4 is extraordinarily easily displaceable in the region 20, and a spaced distance thereof from the plate cylinder 1 can thereby be readily increased, so that the foreign bodies that have entered the nip can be withdrawn out of the nip by exerting only a relatively slight force.

Figure 2A:
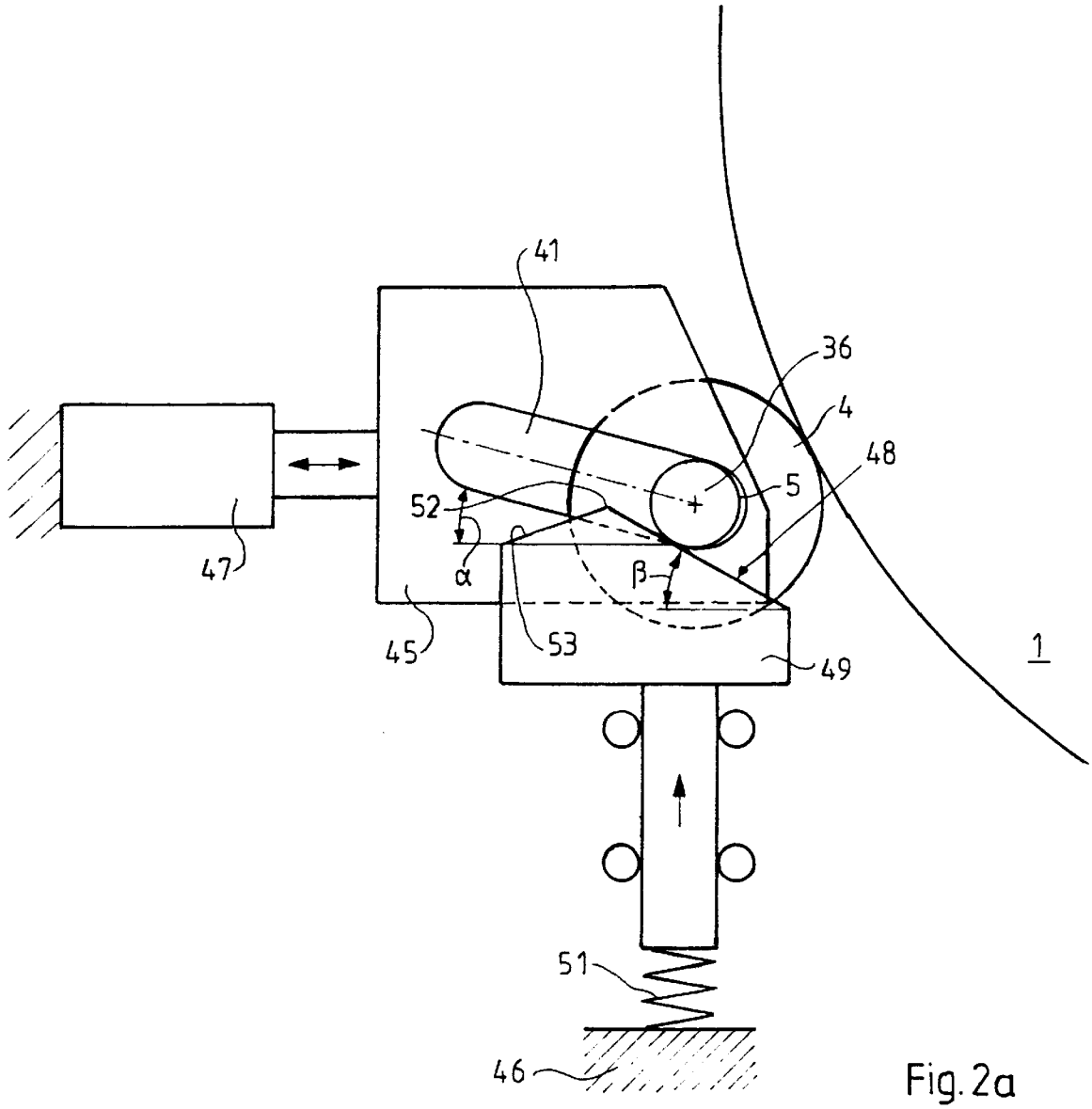
FIG. 2*a* is a diagrammatic and schematic side elevational view of a second exemplary embodiment of the safeguarding device in an operating phase thereof wherein a contact-pressure roller is disposed in engagement with a plate cylinder.
Figure 2B:
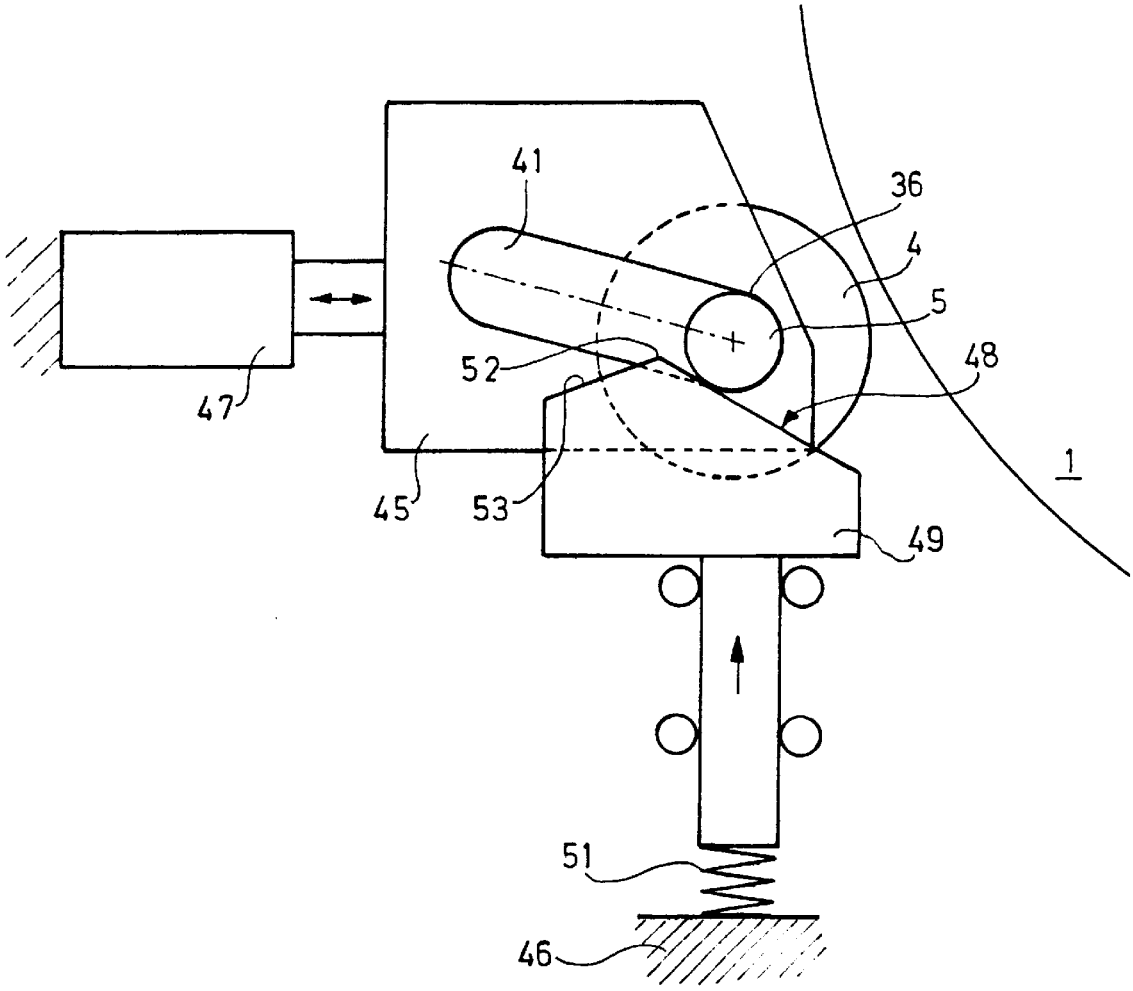
FIG. 2*b* is a view like that of FIG. 2*a* of the second embodiment of the device in another operating phase wherein the contact-pressure roller is disposed at a spaced distance away from the plate cylinder.
Figure 2C:
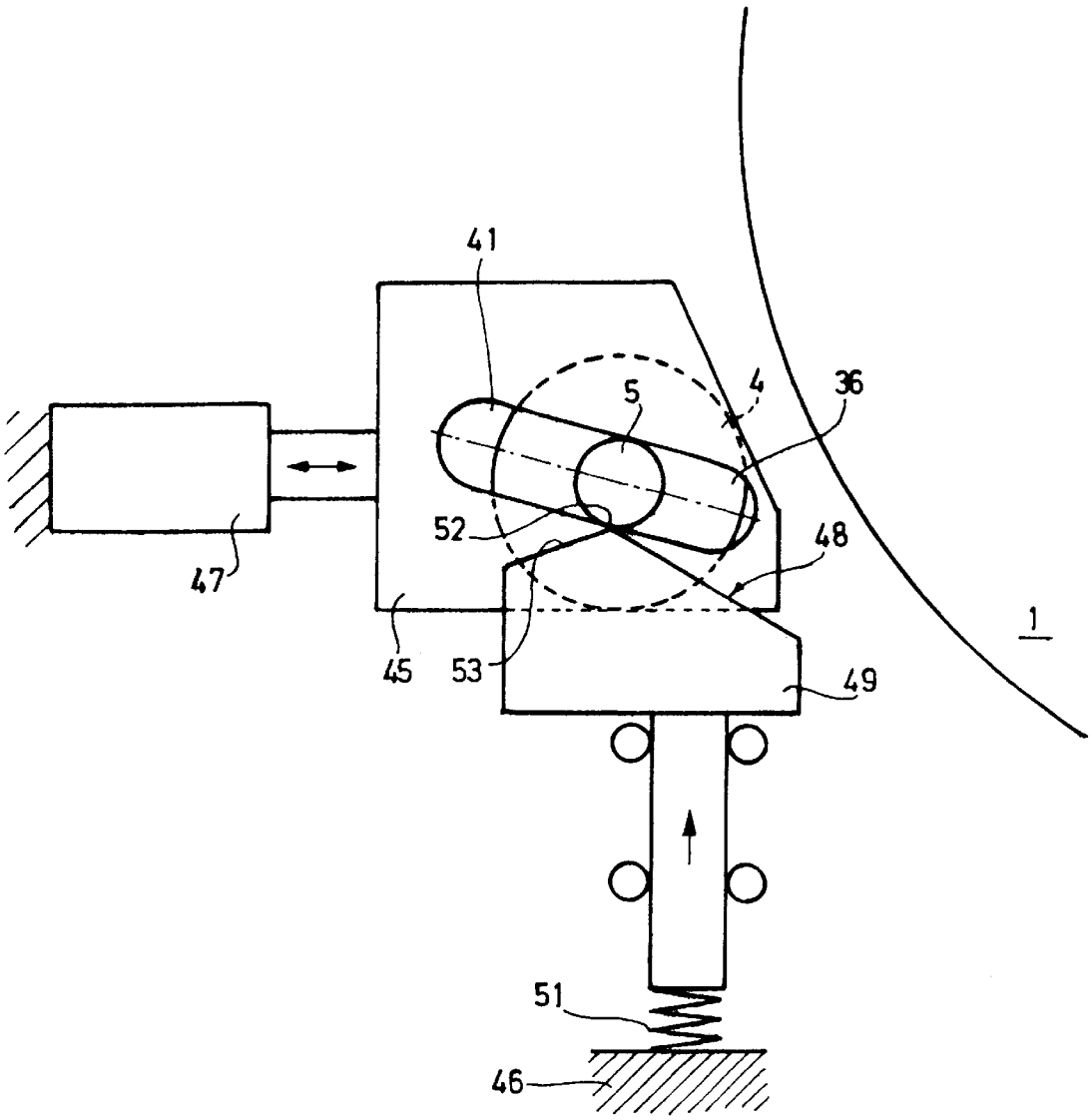
FIG. 2*c* is another view like those of FIGS. 2*a* and 2*b* showing the device in a further operating phase wherein the contact-pressure roller is forcibly pressed away from the plate cylinder.

Because of the mirror-symmetrical arrangement of a second exemplary embodiment of the invention shown in FIGS. 2*a*, 2*b* and 2*c*, a description thereof is presented hereinafter with respect to only one side thereof. As illustrated in FIGS. 2*a*, 2*b* and 2*c*, the shaft 5 of the contact-pressure roller 4 is supported displaceably by ends 36, respectively, of the shaft 5 or of the roller 4 in a guide 41 formed with a slot. The guide 41 is mounted on a holder 45, which is displaceably supported substantially horizontally by a pneumatic cylinder 47 disposed rigidly on a side frame 46, so that the contact-pressure roller 4 can be positioned against or into engagement with the plate cylinder 1 and moved away therefrom. The guide 41 is inclined to the horizontal, so that an acute angle a is formed. The end 36 protrudes through the slot 41 and, in the condition wherein the contact-pressure roller 4 is positioned against or engages the plate cylinder 1, this end 36 rests on an incline 48 of an actuating element 49. The incline 48 forms an angle β with the horizontal that is larger than the angle a formed between the guide 41 and the horizontal. The actuating element 49 is displaceably supported on the side frame 46 of the printing press, counter to the force of a restoring spring 51, and presses the contact-pressure roller 4 with the force of the spring 51 against the plate cylinder 1. The incline 48 terminates at an apex point 52 into an incline 53 having negative pitch or, in other words, a decline.

For applying a printing plate, the contact-pressure roller 4 is positioned against or brought into engagement with the plate cylinder 1 by the pneumatic cylinder 47. In this regard, the end 36 of the contact-pressure roller 4 or the shaft 5 thereof slides downwardly, as viewed in FIGS. 2*a* to 2*c*, in the guide 41 until the circumference of the contact-pressure roller 4 comes into operative engagement or connection with the printing plate disposed on the circumference of the plate cylinder 1. At the same time, the incline 48 presses against the end 36 and thus presses the contact-pressure roller 4 against the plate cylinder 1 and against the printing plate to be applied to the plate cylinder 1, respectively. If a foreign body should enter the nip between the contact-pressure roller 4 and the plate cylinder 1 during the application of the printing plate, a deflection movement of the contact-pressure roller 4 and consequently a movement of the contact-pressure roller 4 away from the plate cylinder 1 takes place. In this regard, the end 36 slides in the guide 41 and presses against the incline 48 protruding into the guide 41, so that the actuating element 49 is displaced counter to the force of the restoring spring 51. A non-illustrated sensor or switch disposed on the actuating element 51 detects the motion of the actuating element 51 and transmits an emergency shutoff signal to the printing-press control the instant the end 36, during the deflection movement of the contact-pressure roller 4, exceeds or passes beyond the apex 52 and reaches the region of the inclines 53. According to the invention, in this region, the restoring spring 51 reinforces the motion of the contact-pressure roller 4 away from the plate cylinder 1. During normal operation, that is, upon the positioning of the contact-pressure roller 4 against and away from the plate cylinder 1, or in other words, when the contact-pressure roller 4 is brought into engagement with or disengaged from the plate cylinder 1, the end 36 always remains in the region of the inclines 48.

We claim:

1. A device for safeguarding against the entry of foreign bodies into a nip between a plate cylinder and a contact-pressure roller disposed parallel thereto and cooperating therewith, comprising:

a movable actuating element formed with a control contour having an ascending incline;

a contour segment adjoining said ascending incline, said contour segment selected from the group thereof consisting of a straight edge and a descending incline;

the contact-pressure roller being formed with ends in cooperative engagement with said control contour;

a restoring spring creating a force; and a switch;

said actuating element being disposed so as to be deflectable counter to the force of said restoring spring and is bringable into operative engagement with said switch.

2. The device according to claim 1, including guides disposed at respective ends of the contact-pressure roller for displaceably supporting said contact-pressure roller.

3. The device according to claim 2, including an adjusting element, said guides being disposed so as to be adjustable by said adjusting element.

4. The device according to claim 1, wherein the contact-pressure roller is formed of a contact-pressure roller body rotatably supported on a shaft.

5. The device according to claim 4, wherein said actuating element is disposed so as to be displaceable at an angle to said shaft of the contact-pressure roller.

6. The device according to claim 5, wherein said angle is a right angle.

7. The device according to claim 1, wherein said actuating element is disposed so as to be displaceable in an axial direction of the contact-pressure roller.

8. A device for safeguarding against the entry of foreign bodies into a nip between a plate cylinder and a contact-pressure roller disposed parallel thereto and cooperating therewith, comprising:

a movable actuating element formed with a control contour having an ascending incline;

a contour segment adjoining said ascending incline, said contour segment selected from the group thereof consisting of a straight edge and a descending incline;

the contact-pressure roller being formed with ends in cooperative engagement with said control contour; and guides disposed at respective ends of the contact-pressure roller for displaceably supporting said contact-pressure roller, said guides forming part of said actuating element, and said control contours being disposed in said guides so that they are in mirror symmetry with one another.

9. The device according to claim 8, including an adjusting element, said guides being disposed so as to be adjustable by said adjusting element.

10. The device according to claim 8, wherein the contact-pressure roller is formed of a contact-pressure roller body rotatably supported on a shaft.

11. The device according to claim 10, wherein said actuating element is disposed so as to be displaceable at an angle to said shaft of the contact-pressure roller.

12. The device according to claim 11, wherein said angle is a right angle.

13. The device according to claim 8, wherein said actuating element is disposed so as to be deflectable counter to a force of a restoring spring and is bringable into operative engagement with a switch.

14. The device according to claim 8, wherein said actuating element is disposed so as to be displaceable in an axial direction of the contact-pressure roller.

15. A device for safeguarding against the entry of foreign bodies into a nip between a plate cylinder and a contact-pressure roller disposed parallel thereto and cooperating therewith, comprising:

a movable actuating element formed with a control contour having an ascending incline;

a contour segment adjoining said ascending incline, said contour segment selected from the group thereof consisting of a straight edge and a descending incline;

the contact-pressure roller being formed with ends in cooperative engagement with said control contour; and guides disposed at respective ends of the contact-pressure roller for displaceably supporting said contact-pressure roller, said guides, respectively, forming an acute angle with a horizontal, and said ascending incline forming with the horizontal an angle which is greater than said acute angle.

16. The device according to claim 15, including an adjusting element, said guides being disposed so as to be adjustable by said adjusting element.

17. The device according to claim 15, wherein the contact-pressure roller is formed of a contact-pressure roller body rotatably supported on a shaft.

18. The device according to claim 17, wherein said actuating element is disposed so as to be displaceable at an angle to said shaft of the contact-pressure roller.

19. The device according to claim 18, wherein said angle is a right angle.

20. The device according to claim 15, wherein said actuating element is disposed so as to be deflectable counter to a force of a restoring spring and is bringable into operative engagement with a switch.

21. The device according to claim 15, wherein said actuating element is disposed so as to be displaceable in an axial direction of the contact-pressure roller.

* * * * *